US007766129B2

(12) United States Patent
Mäkela et al.

(10) Patent No.: US 7,766,129 B2
(45) Date of Patent: Aug. 3, 2010

(54) ELEVATOR CONTROL SYSTEM

(75) Inventors: Marjukka Mäkela, Helsinki (FI); Tomi Sipilä, Espoo (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 11/802,713

(22) Filed: May 24, 2007

(65) Prior Publication Data

US 2007/0272495 A1 Nov. 29, 2007

Related U.S. Application Data

(63) Continuation of application No. PCT/FI2005/000536, filed on Dec. 19, 2005.

(30) Foreign Application Priority Data

Dec. 30, 2004 (FI) ..... 20041690

(51) Int. Cl.
*B66B 1/34* (2006.01)

(52) U.S. Cl. ..... 187/396; 187/382; 187/392

(58) Field of Classification Search ..... 187/380–388, 187/391–396
See application file for complete search history.

(56) References Cited

U.S. PATENT DOCUMENTS

| | | | | |
|---|---|---|---|---|
| 4,685,538 | A | 8/1987 | Kamaike | |
| 4,691,808 | A | 9/1987 | Nowak et al. | |
| 4,989,694 | A * | 2/1991 | Ueshima et al. | 187/380 |
| 5,183,981 | A | 2/1993 | Thangavelu | |
| 5,689,094 | A | 11/1997 | Friedli et al. | |
| 5,952,626 | A * | 9/1999 | Zaharia | 187/381 |
| 6,062,346 | A * | 5/2000 | Friedli et al. | 187/395 |
| 6,202,799 | B1 * | 3/2001 | Drop | 187/388 |
| 6,315,083 | B1 * | 11/2001 | Schuster et al. | 187/391 |
| 6,382,363 | B1 * | 5/2002 | Friedli | 187/384 |
| 6,397,976 | B1 * | 6/2002 | Hale et al. | 187/392 |
| 6,772,862 | B2 * | 8/2004 | Friedli | 187/247 |
| 6,801,792 | B1 * | 10/2004 | Schuster et al. | 455/566 |
| 6,868,945 | B2 * | 3/2005 | Schuster et al. | 187/380 |
| 7,040,458 | B2 * | 5/2006 | Forsythe et al. | 187/396 |
| 7,353,915 | B2 * | 4/2008 | Zaharia et al. | 187/388 |
| 7,500,544 | B2 * | 3/2009 | Hakala et al. | 187/382 |
| 2001/0035314 | A1 * | 11/2001 | Yoshida et al. | 187/382 |
| 2003/0008507 | A1 | 1/2003 | Bell et al. | |

FOREIGN PATENT DOCUMENTS

| | | |
|---|---|---|
| GB | 2 241 090 A | 8/1991 |
| JP | 2-225272 A | 9/1990 |
| WO | WO-2004/005052 A2 | 1/2004 |

* cited by examiner

*Primary Examiner*—Jonathan Salata
(74) *Attorney, Agent, or Firm*—Birch, Stewart, Kolasch & Birch, LLP

(57) ABSTRACT

For entry of calls in an elevator system, a destination call is entered outside the elevator car if the starting floor is a floor with intensive departing traffic. On other floors, a collective-control up or down call is entered traditionally and then a destination call in the elevator car. An identified regular customer may be allowed to select and confirm a destination floor from among one or more preprogrammed alternatives. Destination preprogrammed floors most frequently used are stored, the starting floor being fixed. Preprogrammed floors can be set for several different starting floors separately. For occasional customers system or regular customers going to floors other than preprogrammed floors, a call is entered as a destination call in the elevator lobby on floors with intensive departing traffic and as an up or down call according to collective control in the elevator lobby and on other floors.

5 Claims, 2 Drawing Sheets

ELEVATOR CONTROL SYSTEM

Figure 1:
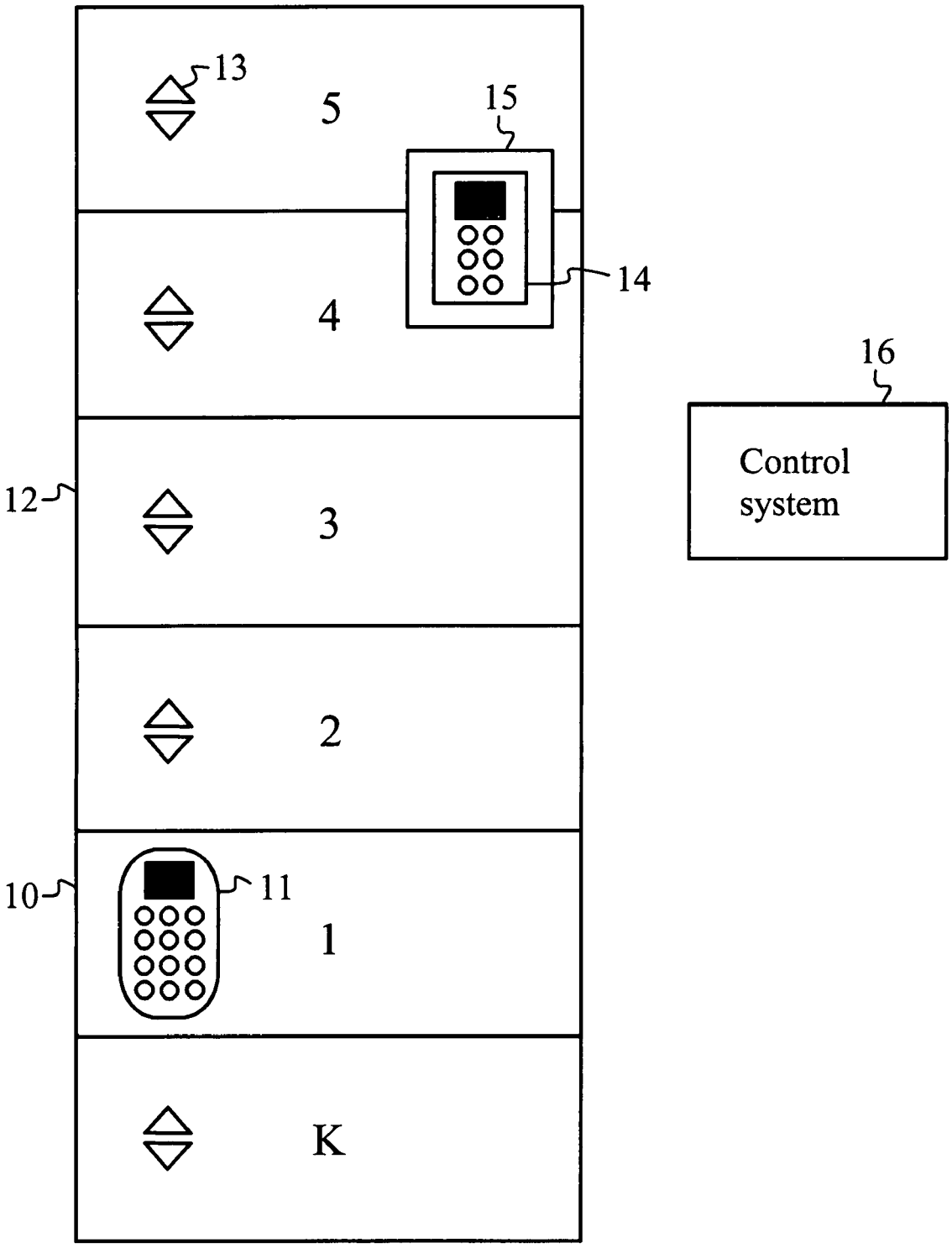

This application is a Continuation of copending PCT International Application No. PCT/FI2005/000536 filed on Dec. 19, 2005, which designated the United States, and on which priority is claimed under 35 U.S.C. §120.

FIELD OF THE INVENTION

The present invention relates to elevator control effected on the basis of calls entered in an elevator system.

BACKGROUND OF THE INVENTION

In the operation of an elevator system, it is essential to receive and process the call data entered by passengers. The problematics consist in determining the most optimal elevator, defined by a desired indicator, for each elevator passenger having entered a call, and controlling the elevators in accordance with the optimization results. In an elevator system, a customer arriving to the elevator calls an elevator to the floor where he/she is currently located by pressing the button of a call device near the elevator door. The commonest solution for implementing the call device is to provide up and down call buttons on each floor, which are used by the customer to indicate to the system the desired traveling direction. In this context, such a call is referred to as a hall call. This traditional method, called collective control, requires the customer to give the actual destination floor information within the elevator car via a separate car operating panel. In the present context, the input of destination floor information is referred to as a destination call, regardless of whether the destination floor information is given in the elevator car or outside it. The collective control method has the disadvantage that the system only learns the customer's destination floor after the elevator has already arrived at the customer's original floor of location. Therefore, it is impossible to allocate only one elevator for passengers wanting a ride to the same destination floor at the same time, because the system knows nothing of the customers' destination floors on the basis of the depressions of up/down buttons. In the aforesaid situation, allocating only one elevator is the most advantageous solution, because this allows the total number of "intermediate stops" in the elevator system to be reduced and consequently the traveling time of people going to different floors in the building to be shortened, which is a pronounced effect especially in the case of passengers traveling to the highest floors.

In destination control of an elevator, the elevator user inputs his/her destination floor to the elevator control system already in the lobby on the starting floor. Thus, the customer only has to enter a call once as no up/down calls are needed. Therefore, no separate call needs to be entered in the elevator car. Destination control gives the elevator control system a possibility to make smarter call allocation decisions, thereby allowing more efficient utilization of elevator capacity. Destination control requires a special destination call device, which has to allow the input of all possible floor numbers and identifiers to the control system. In practice, it is often sufficient for the destination call device to contain number keys 0-9. Due to the destination call device, destination control may be more expensive than traditional collective control.

So-called "full destination" method in this context refers to a destination control system in which all floors served by an elevator group are provided with destination call devices. In such a system it is not possible to enter a traditional up or down call, but the user always has to enter a destination call. Therefore, the normal car operating panel is not needed in this system.

A problem with collective control is that the system is not informed about the customers' destination floors until after the customer has entered the elevator car. For this reason, elevator allocation in large elevator systems with large numbers of customers can be accomplished in a smarter way by using destination control. Destination control again involves the problem of higher costs as compared to the collective control system.

OBJECT OF THE INVENTION

The object of the present invention is to combine certain favorable aspects of traditional collective control and destination control so as to improve the efficiency of operation of the elevator control system.

BRIEF DESCRIPTION OF THE INVENTION

As for the features of the invention, reference is made to the claims.

The method and system of the invention are characterized by what is stated in the claims. Inventive embodiments are also presented in the description part and drawings of the present application. The inventive content disclosed in the application can also be defined in other ways than is done in the claims. The inventive content may also consist of several separate inventions, especially if the invention is considered in the light of explicit or implicit sub-tasks or in respect of advantages or sets of advantages achieved. In this case, some of the attributes contained in the claims may be superfluous from the point of view of separate inventive concepts.

Within the framework of the basic concept of the invention, features of different embodiments of the invention can be applied in conjunction with other embodiments.

The method of the present invention describes a call input system and corresponding equipment to be used in the elevator system. In an embodiment of the present invention, so-called floors with intensive departing traffic are defined, such a floor being typically e.g. the lobby floor of an office building. On the floors thus defined, only direct destination calls are input via a special destination call device placed outside the elevator car in the elevator lobby. In this case, the customer does not have to input a separate call in the elevator car. If the customer's starting floor is other than a floor with intensive departing traffic, then he/she will first enter a hall call in the traditional manner by means of up/down buttons and then a destination call via an operating panel in the elevator car.

In a second embodiment of the present invention, the customer coming to the elevator is identified. If the customer identified is a so-called regular customer who regularly uses the elevator system, his/her most frequently used destination floors are stored in a database. The destination floor data may comprise one or more destination floors per regular customer. The system can learn this destination floor information related to regular customers on the basis of earlier observations, by studying the direct destination calls entered. Another alternative is that the operator of the elevator system separately feeds each regular user's most frequent destination floor into the database. If the elevator rides starting from the lobby of an office building are considered, such a floor stored in the database is typically the floor where the employee's workplace is located. Likewise, the destination floor data per regular customer to be fed into the database may comprise several parts, of which each part comprises the destination floor or floors associated with one starting floor.

When a database concerning regular customers exists, the information can be utilized to improve the efficiency of call control. When a customer arrives at an elevator, he/she is identified by technology comprised in the call input equipment but not separately defined in the present invention. If the arriving customer is identified as a regular user of the elevator system, i.e. as a regular customer, then the information relating to the regular customer and starting floor in question is retrieved from the database, regarding one or more of the regular user's typical destination floors. The destination floor (or destination floors) anticipated by the system is displayed on a call panel, via which the regular customer can confirm it. The system works in such a way that, after identification of a regular customer, if the regular customer wants a ride to a floor other than his/her most typical destination floor, then he/she will have to enter a direct destination call (on floors with intensive departing traffic) via the destination call panel or an up/down call via corresponding buttons (on floors with less intensive departing traffic). When the regular customer wants a ride to a typical destination floor, he/she can acknowledge this by pressing a specific confirm button or, on the other hand, the system can be so implemented that the suggested typical destination floor is automatically confirmed to the elevator control system if the regular customer does not input a different call within a desired (short) time. As stated above, the regular customer may have several typical destination floors and he/she can select a desired destination floor from among these floors via the panel.

If the identified customer is not a regular customer but an occasional user of the system, then he/she will act as in the above-described first embodiment of the invention. On the floors with intensive departing traffic, an occasional customer has to enter a traditional destination call via a destination call device, and on other floors he/she has to input an up or down call as in collective control in the elevator lobby and a destination call in the elevator car.

An identified regular customer can also be granted a right to use functions that are intended only for his/her personal use along with other holders of such a right. A regular user may have a possibility to select a destination floor that occasional visitors are denied access to.

LIST OF FIGURES

Figure 2:
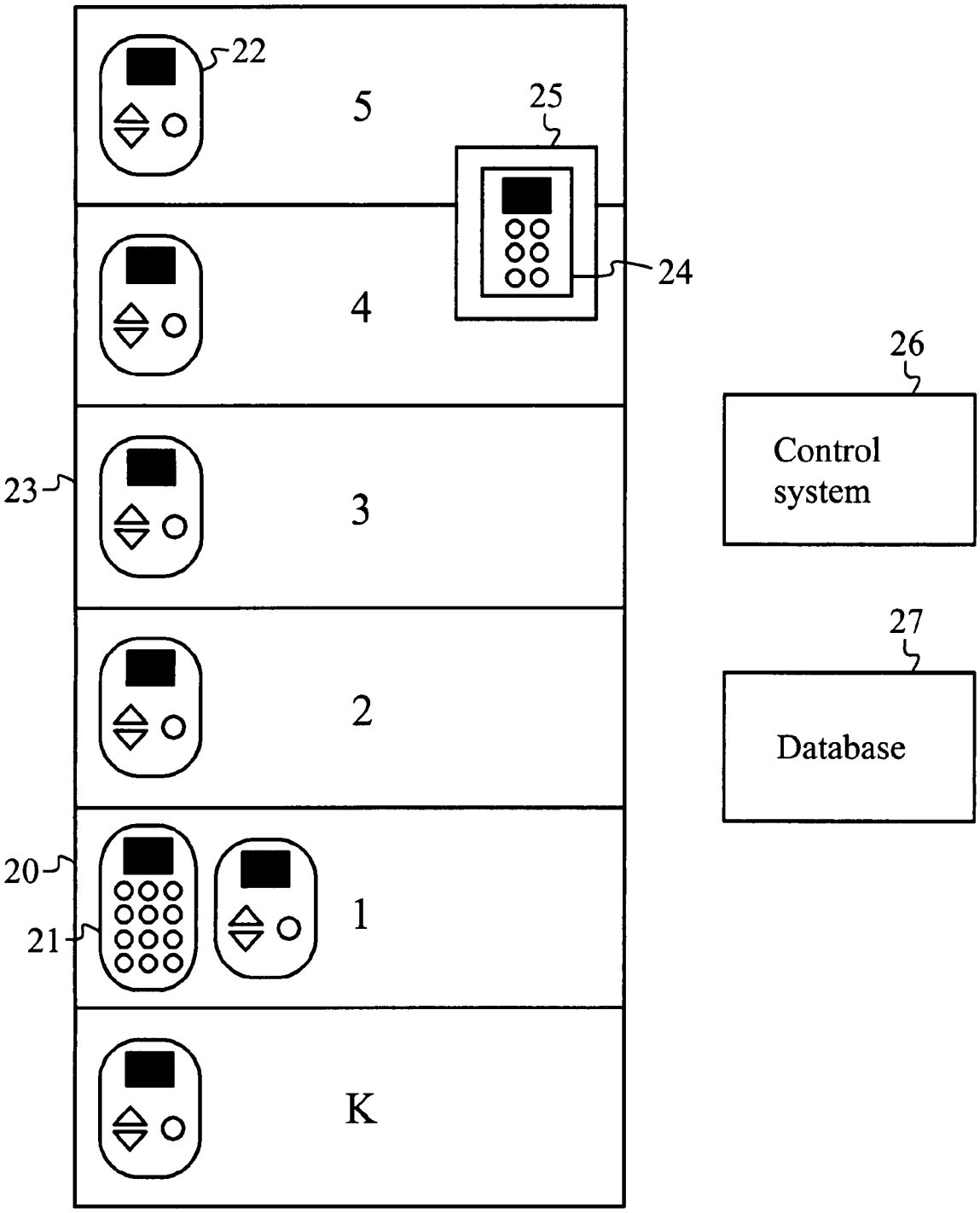

FIG. 1 presents an example of a "hybrid"-concept call input apparatus according to the present invention, and FIG. 2 presents an example of a "hybrid plus"-concept call input apparatus according to the present invention.

DETAILED DESCRIPTION OF THE INVENTION

The method of the present invention for controlling an elevator group combines aspects of the collective control system and the destination call control system. The new method is called here a hybrid-type control system. FIG. 1 presents the call input devices required in the control system, along with different floor types.

On floors 10 with intensive traffic to other floors of the building, a destination control system is used. Such a floor may typically be e.g. the entrance floor 10 of the building. Passengers going to the same floors can be guided to the same elevator cars, and thus the number of stops can be minimized. Floors where the departing traffic exceeds a desired limit can be designated as floors with intensive traffic 10, and these floors are provided with a so-called complete call panel 11 containing number keys, which is placed near the elevator door. The call panel 11 may naturally be located farther away, e.g. at a distance of 15 m from the elevator door.

On floors 12 where calls are entered more sporadically, traditional collective-control up and down calls 13 are used. Such floors 12 are typically e.g. the upper floors of an office building. On the floors with less intensive traffic thus defined, a destination control system would not provide any actual advantage because a large proportion of the elevator users want a ride to the exit floor or, on the other hand, due to the small passenger flow on that floor, it is not possible to guide them within a reasonable waiting time into the same elevator with other passengers going to the same floor. On such floors 12, it is advantageous to employ collective control, using a genetic algorithm to minimize passenger waiting times.

In the hybrid-type call system, a traditional car operating panel (COP) 14 needs to be installed inside each elevator car 15, because collective control in any case requires the use of a COP 14. The operation of the elevator system is controlled and monitored by a control system 16, which takes care of the allocation of elevators to passengers on the basis of existing calls. Naturally, the operating panel 14 may differ from that presented in the figure; for example, the display screen shown in black is not necessarily needed.

On floors other than the floors with intensive departing traffic, the additional value regarding traffic efficiency provided by destination calls is generally marginal. Destination call panels 11 are clearly more expensive than conventional up/down buttons 13, and therefore the most effective solution for the buyer of the elevator system in respect of costs is to use the destination control system only on those floors where it provides a significant advantage and the cheaper collective control together with up/down buttons on the other floors.

In an embodiment of the method of the present invention, the hybrid-type control system is developed still further. In this embodiment, too, functions of collective control and hybrid-type control are combined. This example is designated a "hybrid plus" control system. FIG. 2 presents the call input devices needed in this control system along with different floor types.

A substantial new addition in the concept is the use of a preprogrammed destination floor based on passenger identification. This comprises two elements. As a first element, the system is provided with a memory for storing a passenger-specific destination floor learned by the system or programmed in it. The system can "learn" a regular user's most typical destination floor (or floors) by observing the destination calls entered and storing these in the database. As a second example, the operator of the elevator system can feed regular users' destination floor information to the system as preprogrammed data. This can be done e.g. in office buildings, where the destination floor is typically the floor where the employee's workplace is located, if the starting floor considered is the lobby floor (entrance floor) of the building. Preprogramming may also have to be used in a situation where previously stored destination floor information has been destroyed for some reason. There may be several destination floor alternatives stored, and these may vary depending on the passenger's starting floor. As a second element, the call entry system comprises an apparatus for identifying the passenger in connection with call input. Based on passenger identification data, passenger-specific destination floor information is retrieved from the database. The call input apparatus based on passenger identification is intended for users regularly visiting the building. The identification can be implemented e.g. by using a remotely readable card carried by the user and a separate reader identifying the card. As a second example, it is possible to use a bio-identifier, one example of which is the customer's fingerprint.

The destination floor information stored in the database may include one or more destination floors for one starting floor and one regular user. If in this situation only one destination floor has been stored, it is sufficient for the regular user to confirm the floor via a confirm button on the panel or even only to enter the elevator. If several destination floors have been stored (for example, the customer frequently travels from the lobby both to the $4^{th}$ floor and to the $5^{th}$ floor), then the customer has to select the right floor e.g. with arrow keys and then confirm it. In the future, it may even be unnecessary for the customer to make a selection. If the customer in this situation wants to travel e.g. from the lobby to the $7^{th}$ floor, he/she will have to use a hall call, i.e. the up button on the panel.

The database can also be arranged in such a way that the destination floor data are starting floor-specific. This means e.g. that it is possible to define typical destination floors A and B for a given regular customer if the starting floor is the lobby floor C, and in addition destination floors C and D can be defined if the regular customer's starting floor is A. In this way the system can be made more "intelligent", but on the other hand this means an increased size of the database.

Preprogramming makes it possible to simplify the call input apparatus. On the base level, i.e. on the floors 20 of intensive departing traffic, the call input apparatus is a so-called full destination panel 21, which is intended for all users. The full destination panel 21 does not necessarily use preprogramming, and it allows the input of calls to any floor. On the base level 20 it is additionally possible to use a simpler and cheaper call panel 22 (a so-called quick panel) based on passenger identification, which can be used to increase the call input capacity on the base level. In this context, the call panel 22 is also referred to as a quick panel. On the base level 20 in this example it is only possible to input destination calls. Thus the system can provide effective service in peak traffic conditions, which play the most essential role in the allocation of elevators. The base level, i.e. the floors with intensive departing traffic, can be either provided with both panels 21 and 22 or, as a second example, the functionalities of a quick panel 22 can be integrated in a full destination panel 21, in which case only panel 21 is needed on the base level.

The call input apparatus on the other floors 23 contains aforesaid panels 22 (quick panel) based on passenger identification, besides which the traditional up/down call buttons are in use. In the example presented in FIG. 2, the up/down call buttons are integrated in panel 22. Thus it is not necessary to install expensive full destination panels 21 on all floors of the building, but regular users can get more efficient elevator service by using preprogrammed destination floors stored in the system. In a regular user's user profile, it is also possible to program a right to use various special functions. These special functions are defined separately for each user. As a special function, it is possible to define for each user e.g. information regarding allowed and denied destination floors. As a second example of special functions, it is possible to specify "high-priority service" for desired users. High priority may mean providing a traveling time as short as possible (comprising the waiting time from input of the call to arrival of the elevator) to certain users regardless of existing calls entered by other users of the system. For example, cleaners can enter a special call to get to a so-called quiet floor, such as e.g. the basement, where no other users are present.

When regular users want a ride to other than preprogrammed floors, an elevator is called by a hall call using up/down buttons 22 as in traditional collective control. After the hall call, a destination call has to be input in the elevator car 25 via the car operating panel 24. This is also the way other than regular users proceed, regardless of the destination floor. Therefore, the elevator cars have to be provided with normal car operating panels 24 in all other examples described except the so-called "full destination" system, because some of the destination calls are only entered in the elevator car.

The elevator system illustrated in FIG. 2 is controlled and monitored by a control system 26. The above-described destination floor data required by the control system are stored in a database 27.

In the "hybrid plus" system described, a larger proportion of the total number of calls consists of destination calls as compared to the simpler hybrid system. This is because in "hybrid plus" some of the calls entered on the upper floors are destination calls. On the other hand, due to the simpler call panel arrangement, a "hybrid plus" system is more advantageous in respect of costs than a "full destination" system. For regular users, the passenger identification function means a better operating convenience because elevator service is tailored to each regular user's individual needs. Occasional users obtain so-called basic service by using conventional up/down buttons outside the base level and destination calls on the base level.

It is obvious to the person skilled in the art that the invention is not limited to the embodiments described above, in which the invention is described by way of example, but that many variations and different embodiments of the invention are possible within the scope of the inventive concept defined in the claims presented below.

The invention claimed is:

1. A method for controlling an elevator system for a building having a plurality of floors served by the elevator and having floors with defined intensive departing traffic and floors which do not have defined intensive departing traffic, comprising:

defining building floors with intensive departing traffic;

providing destination call panels only on floors with defined intensive departing traffic;

providing traditional up/down call panels on floors which do not have defined intensive departing traffic;

inputting direct destination calls to the system using a destination call device placed outside of an elevator car;

determining and storing, on an elevator system customer-specific basis, information regarding one or more destination building floors most frequently used if the customer is a regular user of the elevator system;

displaying on a destination call panel, one or more most frequently used destination floors for said regular customer; and providing confirmation means which confirms that one of the one or more of the most frequently used floors displayed on the destination call panel is the floor at which said regular customer wants the elevator to stop.

2. The method of claim 1, wherein the system confirmation means automatically confirms the customer's desired destination if the regular customer does not input a call within a predetermined time period.

3. The method of claim 1, wherein the system confirmation means includes a specific confirmation button.

4. The method of claim 1, wherein the system confirmation means automatically confirms the customer's desired destination if the customer enters the elevator.

5. A method of operating a building elevator in a building having a plurality of floors served by the elevator and having floors with defined intensive departing traffic and floors which do not have defined intensive departing traffic having a call input system, comprising:

defining building floors with intensive departing traffic;

providing destination call panels only on floors with defined intensive departing traffic;

providing traditional up/down call panels on floors which do not have defined intensive departing traffic;

inputting to the system direct destination calls using a destination call device placed outside of an elevator car;

if the customer identified as a passenger who regularly uses the elevator system, storing the customer's most frequently used destination floors in a database;

displaying on a destination call panel, a most frequently used destination floor for said regular customer; and providing a device by which said regular customer confirms that the most frequently used destination floor that is displayed on the destination call panel can confirm that the displayed floor is the floor at which said regular customer wants the elevator to stop.

* * * * *